US006945822B2

(12) United States Patent
Flemming et al.

(10) Patent No.: US 6,945,822 B2
(45) Date of Patent: Sep. 20, 2005

(54) SACRIFICIAL CIRCUIT CONNECTOR FOR CONNECT/DISCONNECT APPLICATIONS THAT EXCEED THE RATED CYCLE LIMITS OF CIRCUIT CONNECTOR TERMINALS

(75) Inventors: Richard W. Flemming, Rochester, NY (US); John M. Palmer, Webster, NY (US); Lee J. Gang, Jr., Rochester, NY (US)

(73) Assignee: Xerox Corporation, Stamford, CT (US)

( * ) Notice: Subject to any disclaimer, the term of this patent is extended or adjusted under 35 U.S.C. 154(b) by 2 days.

(21) Appl. No.: 10/737,268

(22) Filed: Dec. 15, 2003

(65) Prior Publication Data

US 2005/0130503 A1 Jun. 16, 2005

(51) Int. Cl.[7] ..... H01R 25/00; H01R 27/02; H01R 31/00; H01R 33/88; H01R 33/90

(52) U.S. Cl. ..... 439/638

(58) Field of Search ..... 439/638, 48, 639, 439/651, 488, 491

(56) References Cited

U.S. PATENT DOCUMENTS

| | | | | |
|---|---|---|---|---|
| 4,802,864 | A * | 2/1989 | Michaels et al. | 439/457 |
| 4,820,201 | A * | 4/1989 | Van Brunt et al. | 439/610 |
| 5,490,785 | A * | 2/1996 | Hein et al. | 439/76.1 |
| 5,687,297 | A | 11/1997 | Coonan et al. | 395/102 |
| 5,982,253 | A * | 11/1999 | Perrin et al. | 333/182 |
| 6,015,314 | A * | 1/2000 | Benfante | 439/517 |
| 6,069,624 | A | 5/2000 | Dash et al. | 345/333 |
| 6,531,657 | B1 * | 3/2003 | Jones et al. | 174/72 A |
| 2004/0005818 | A1 * | 1/2004 | Judge et al. | 439/638 |

* cited by examiner

*Primary Examiner*—Chandrika Prasad

(57) ABSTRACT

A sacrificial circuit connector for interposition between male and female connector terminals for applications in which the expected connect and disconnect cycles may exceed the rated cycle limits of at least one of the connector terminals. The structure of sacrificial connector is largely determined by the need for connection compatibility between the sacrificial connector and the connector terminals. By making repeated disconnections at the sacrificial connector rather than between the connector terminals, the usable life of at least one connector terminal can be significantly increased, thereby adding efficiency and reliability while decreasing costs.

1 Claim, 3 Drawing Sheets

SACRIFICIAL CIRCUIT CONNECTOR FOR CONNECT/DISCONNECT APPLICATIONS THAT EXCEED THE RATED CYCLE LIMITS OF CIRCUIT CONNECTOR TERMINALS

BACKGROUND AND SUMMARY

The claimed invention relates to the field of circuit connectors, and more particularly to circuit connectors rated for a limited number of connect and disconnect cycles.

Electrical components in computers and complex machinery often are connected to each other and to power and control circuits by various types of electrical, or, increasingly, optical connectors rather than soldered or other semi-permanent means of connection. Some electrical connectors are ruggedly made and can be cycled through connections and disconnections innumerable times. Typical 2-to-3 prong connectors found commonly in hardware stores are examples of durable connectors. As the number of wires to be connected increase, then the expense of durable connectors increases significantly.

Many modern machine systems require multiple wiring harnesses to convey power and data between and among components. To minimize expense, inexpensive connectors rated for a minimal number of connect and disconnect cycles are often used. Thin wires, typically of 18-gauge and higher, are coupled to such inexpensive connectors singly or in wire ribbons. Coupling of the wire(s) to connectors terminals at a factory is typically accomplished by automated crimping of the attachment features of connector pins or sockets over and/or around the inserted wire. When using small gauge wires (18 Gauge or above), such crimped connections are typically limited to ratings of between 25 and 150 mating and unmating, or connect and disconnect, cycles. Failures occur for multiple reasons, including abrasive wear of contact materials through which circuits are completed within the connector, metal fatigue of the wires from being handled more than the rated number of cycles, fraying of the wires, metal fatigue of the crimped portions of the connector, and the loosening of the crimped fasteners from the connector pins and sockets after the rated number of cycles. Durability can vary greatly depending upon specific design features and materials used. For example, a connector using tin/lead connector compositions may be rated at 30 cycles while essentially the same connector using a gold connector composition may be rated 100 cycles or more. (See, e.g., Molex IDT™ connector 71694 and its data sheet description on the Molex website. Vendors such as Molex Incorporated and Tyco Electronics, a division of Tyco International, Ltd., (using its AMP brand) generally determine cycle ratings using standard protocols such as EIA (Electronic Industry Alliance) Standard 364-09, Revision C (1999) entitled "Durability Test Procedure For Electrical Connectors and Contacts".

Groupings of wires, including ribbons of wires, with connectors at both ends form wire harnesses. Typically, one end connector is male and the other is female. Connectors at either end are rated based upon the number of mating and unmating cycles each such connector is expected to reliably endure. Wiring harnesses are a common and preferred means for routing power and data circuits since they can be pre-assembled in an off-line assembly system and then easily inserted into a machine system during machine manufacturing. During machine assembly, power and data wires from various subsystems are routed to a common connector in order to be ready for connection to a harness. Wires within the harness then connect the subsystems to power, data sources, and other appropriate subsystems.

Connectors at either end of wiring harnesses are prone to failure for reasons such as those described above. Harnesses with robust connectors are available but at a high cost. Harnesses with connectors rated for fewer than 100 cycles cost much less but still typically cost in excess of about $0.10 to about $0.20 for a 2-wire harness. If a connector is cycled more than its rated number of cycles, then good practice is to replace it. Replacement costs thus include the cost of replaced harness, labor to make the replacement, and wear and tear on the connectors that are connected to the replaced harness. Accordingly, it is desirable to require replacement of harnesses as infrequently as possible.

In complex systems such as middle and high-end printers and copiers, certain components are depleted or wear out with regularity. Since printing systems are designed to last a significant number of years, periodic replacement of exhausted subsystems requires that electrical or optical and mechanical connectors between the replaced subsystem and connected systems be cycled through many mating and unmating cycles during the life of the machine. For cost reasons, inexpensive electrical connectors are often used both as components of wire harnesses and as connectors to wire harnesses. In the typical useful life of a printer, many subsystems will require replacement and, periodically, many wiring harnesses with inexpensive connectors will need replacement or become the source of reliability problems.

It would be desirable to provide a set of inexpensive connectors that, although each is rated for a limited number of cycles, such connectors provide extended cycle life for wiring harnesses and connectors fastened thereto.

One embodiment of the present invention is a sacrificial circuit connector for interposition between male and female connector terminals for applications in which the expected connect and disconnect cycles may exceed the rated cycle limits of at least one of the connector terminals, said sacrificial connector comprising: a connector body having a male and a female connector side, at least one of such sides having connection compatibility to a connector terminal rated for cycle limits less than the number of cycles expected for the application; at least one circuit coupling element through which a circuit can be completed located on the male side; at least one circuit coupling element through which a circuit can be completed located on the female side; and a circuit conduit within the connector body for connecting the circuit between the female side coupling element and the male side coupling element; and wherein the male side is connection compatible with the female connector terminal and the female side is connection compatible with the male connector terminal.

Another embodiment is a process for extending the life of connector terminals, comprising: forming a connector body having a male and a female connector side, at least one of such sides having connection compatibility to a connector terminal rated for cycle limits less than the number of cycles expected for the application; locating on the male side at least one circuit coupling element through which a circuit can be completed; locating on the female side at least one circuit coupling element through which a circuit can be completed; enclosing at least one circuit conduit within the connector body for connecting the circuit between the female side coupling element and the male side coupling element; and connecting one side of the connector body to at least one connector terminal.

Another embodiment is an electrophotographic printer, comprising: a sacrificial circuit connector for interposition between male and female connector terminals for applications in which the expected connect and disconnect cycles may exceed the rated cycle limits of at least one of the connector terminals, said sacrificial connector comprising: a connector body having a male and a female connector side, at least one of such sides having connection compatibility to a connector terminal rated for cycle limits less than the number of cycles expected for the application; at least one circuit coupling element through which a circuit can be completed located on the male side; at least one circuit coupling element through which a circuit can be completed located on the female side; and a circuit conduit within the connector body for connecting the circuit between the female side coupling element and the male side coupling element; and wherein the male side is connection compatible with the female connector terminal and the female side is connection compatible with the male connector terminal.

Yet another embodiment is a sacrificial circuit connector for interposition between the connector terminals of a machine harness and a connector terminal for a component having a limited life for applications in which the expected connect and disconnect cycles may exceed the rated cycle limits of the machine harness connector terminal, said sacrificial connector comprising: means for connection compatibility with the machine harness connector terminal; means for connection compatibility with the connector terminal for the component; and a circuit conduit within the sacrificial connector for connecting the circuit between the machine harness connector terminal and the connector terminal for the component.

DETAILED DESCRIPTION

Figure 1:
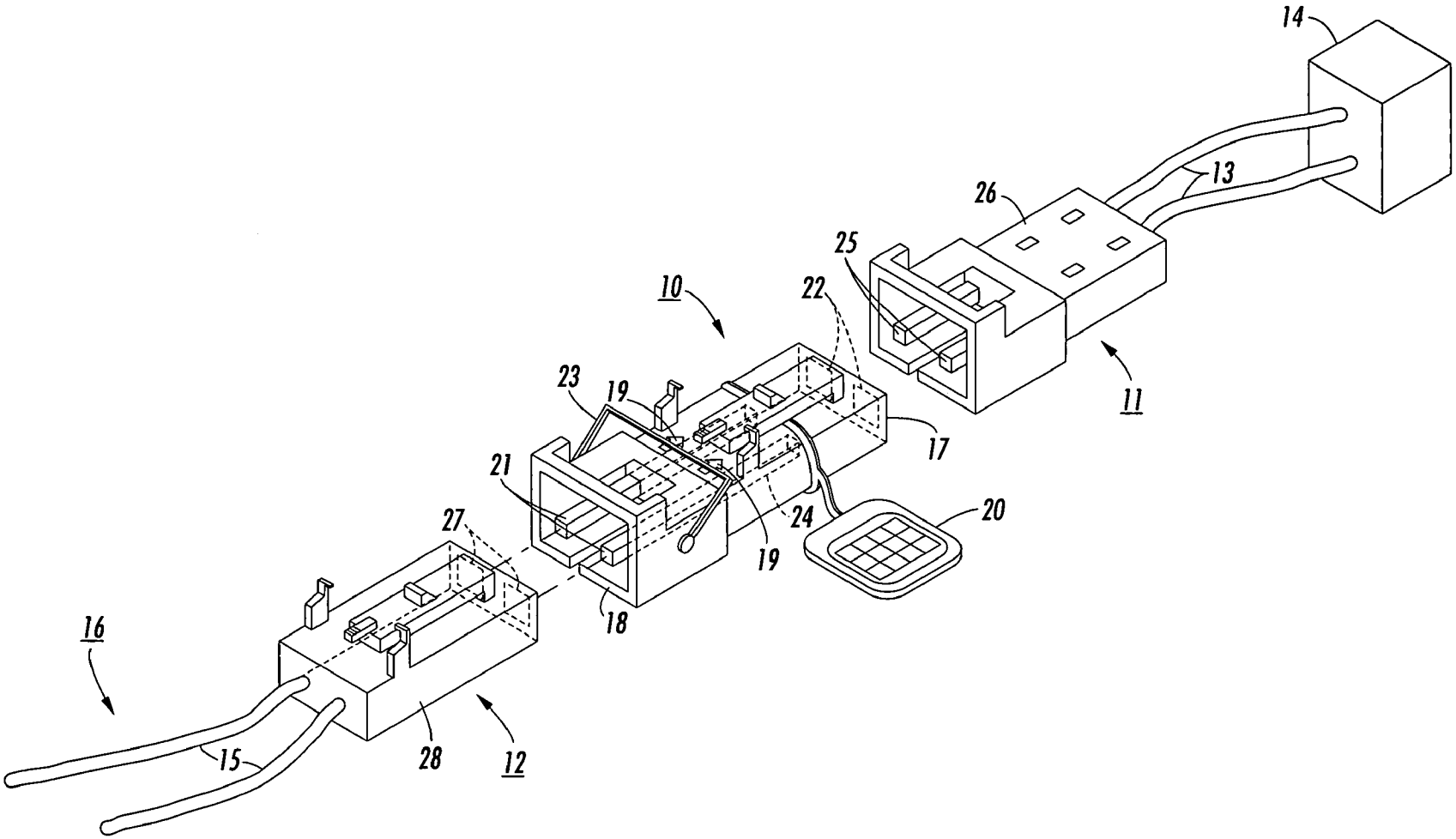
FIG. 1 is an elevated perspective view of one sacrificial connector embodiment of the present invention.

For a general understanding of the present invention, reference is made to the drawings. In the drawings, like reference numerals have been used throughout to designate identical elements.

An exemplary electronic system comprising one embodiment of the present invention is a multifunctional printer with print, copy, scan, and fax services. Such multifunctional printers are well known in the art and may comprise print engines based upon ink jet, electrophotography, and other imaging devices. The general principles of electrophotographic imaging are well known to many skilled in the art. Generally, the process of electrophotographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

The above described electrophotographic reproduction process is well known and is useful for both digital copying and printing as well as for light lens copying from an original. In many of these applications, the process described above operates to form a latent image on an imaging member by discharge of the charge in locations in which photons from a lens, laser, or LED strike the photoreceptor. Such printing processes typically develop toner on the discharged area, known as DAD, or "write black" systems. Light lens generated image systems typically develop toner on the charged areas, known as CAD, or "write white" systems. Embodiments of the present invention apply to both DAD and CAD systems. Since electrophotographic imaging technology is so well known, further description is not necessary. See, for reference, e.g., U.S. Pat. No. 6,069,624 issued to Dash, et al. and U.S. Pat. No. 5,687,297 issued to Coonan et al., both of which are hereby incorporated herein by reference.

Referring initially to FIG. 1, one embodiment of the present invention is shown as sacrificial connector 10 interposed between female connector terminal 11 and male connector terminal 12. Female connector terminal 11, including pins 25 and terminal body 26, is coupled to wires 13 which, in turn, are coupled to component 14. Male connector terminal 12, including sockets 27 and terminal body 28, is one end of a simple 2-wire harness 16 comprised of wires 15 carrying, in this embodiment, either electrical power or data. Wires 15 are coupled internally to body 28 to sockets 27. In one typical embodiment represented in FIG. 1, component 14 may be a thermistor for a fuser oil metering roller in an electrophotographic printer. Such a thermistor may be expected to be connected and disconnected over 100 times (cycles) during the life of the machine. Such cycles are expected either for replacement of the thermistor or due to normal diagnostic and repair procedures. In the example provided, male connector terminal 12 may be rated for 25 cycles. If connector 12 is coupled directly to connector 11, then wire harness 16 would normally need to be replaced at least 4 times during the life of the machine provided that the system in fact experiences over 100 cycles. Alternatively, a service representative will need to cut wires 15 and to crimp onto replacement sockets 27 within terminal connector 12. Such in situ replacements, usually involving manual crimping, introduces yet another source of decreased reliability.

The structure of sacrificial connector is largely determined by the need for connection compatibility between the sacrificial connector and the connector terminals. It is expected that sacrificial connector 10 will usually have a male end 17 and a female end 18. Each end can be a simple clone of the comparable portions of connectors 11 and 12. In the example shown, circuit coupling element 21 at the female end 18 comprises projection pins while circuit coupling element 22 at the male end comprises receptacles, or sockets, for receiving projection pins as well as contacts for completing a circuit with the pins. A circuit element, or circuit conduit 24, is fully or partially enclosed within the body of sacrificial connector 10 and serves to complete the circuit between pins 21 and receptacles 22. Circuit conduit 24 may comprise an extended length of pins 21 that traverse the body of sacrificial connector 10 and terminate at sockets 22.

Sacrificial connector 10 can be designed as an inexpensive connector with cycle ratings comparable to the ratings of connectors 11 and/or 12. Since sacrificial connector 10 need not have any external wires, however, it is likely that sacrificial connector 10 has a greater cycle life and reliability than either connectors 11 or 12 even if comprised of similar materials and similar features as the connector terminals to which it is designed to be attached. Hence, in the configuration shown, sacrificial connector 10 may have a cycle rating in excess of 100 cycles even though it is comparable in expense to each of connectors 11 and 12. The cycle life of sacrificial connector 10 can be rated in the same manner as the cycle life of connector terminals 11 and 12 using test protocols issued by an industry body issuing standards such as Electronic Industry Alliance Standard 364-09, Revision C (1999).

In the event that anticipated cycles exceed the cycle rating of sacrificial connector 10 plus the cycle rating of connector terminal 12, then multiple sacrificial connectors can be connected in series to extend the life of both connectors 12 and 11. Another alternative embodiment involves the use of optical fibers rather than electrical circuits. In this embodiment, wires 13 would comprise optical fibers, and connector 10 would be adapted to comprise an optical connector. In all embodiments, sacrificial connector 10 will have both physical mating capability and circuit completion capability with connector terminals 11 and 12. Such connection compatibility enables interposition of sacrificial connector 10 between connector terminals 11 and 12 without significantly increasing installation and maintenance costs and efforts.

In order to further assure preservation of connector 12, one embodiment comprises an indicia that identifies sacrificial connector 10 as the connector to be disconnected from connector 11 during each cycle rather than disconnecting connector 12 from sacrificial connector 10. One method of creating such identification may be to color or otherwise visually mark sacrificial connector 10 in a manner that informs an user which end to disconnect. In the example shown, such indicia are indicated by arrows 19 that are printed on the body of sacrificial connector in a location that can be observed when fully connected to connector 11. Any number of indicia systems are possible, including placing of a color such as red prominently at end 18 or green at end 17. Another embodiment may comprise use of removably attached members that attach between end 18 and connector terminal 12 in order to indicate that the connector 12/sacrificial connector 10 interface is not to be disconnected unless necessary. Such removably attached members may comprise a simple flexible band tape-like material or a hinged latch member that removably latches to connector terminal 12. In FIG. 1, a hinged latch member 23 is shown in its retracted position.

Another variation is to add an ability to track the number of cycles that sacrificial connector 10 has endured. In one embodiment, such a tracking feature is shown in FIG. 1 as a tag 20 coupled or otherwise associated with connector 10. This is a low cost solution in which users are instructed to manually make an indicia on the tag for each implemented cycle. In the embodiment shown, such indicia are counted as a series of areas defined by rectangular boxes on tag 19. Any manual indicia would suffice, including, for example, recording simple straight strokes for each cycle.

Figure 2:
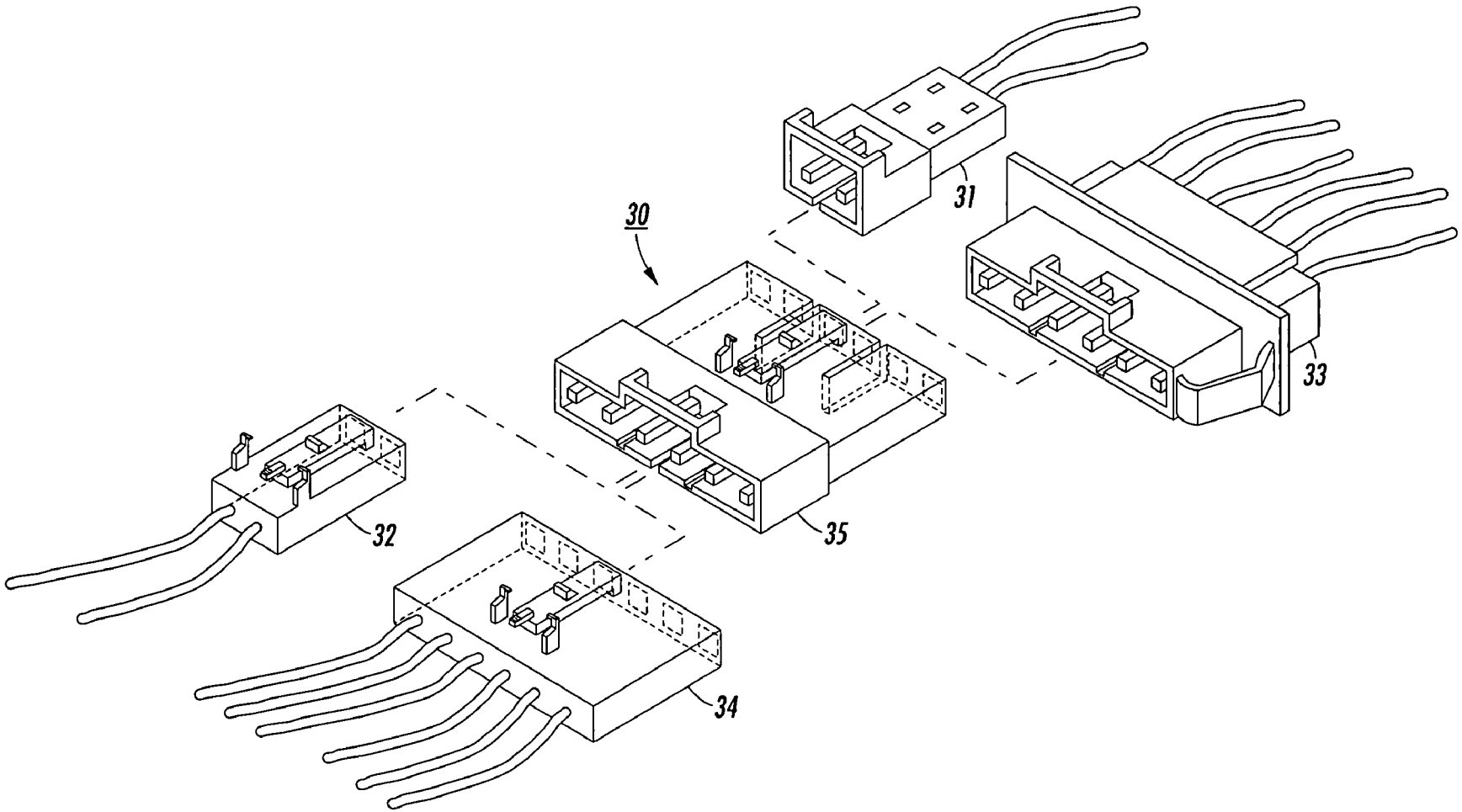
FIG. 2 is an elevated perspective view of second sacrificial connector embodiment of the present invention in which the sacrificial connector is connection compatible with a plurality of connector terminal configurations.

Referring to FIG. 2, another embodiment of the invention is shown. In this embodiment, sacrificial connector 30 is capable of being connected a plurality of different style connectors. Specifically, 2-wire harness connectors and 31 have a different cross-sectional connection profile than 6-wire connectors 33 and 34. Sacrificial connector 30, however, has both the slim-profile and the width to mate with connector 34 as well as a raised section 35 to accommodate the thickness of connector 32. The result is that a single inventory of sacrificial connectors 30 can accommodate a plurality of applications, and overall planning, purchasing, and inventory costs can be minimized.

Figure 3:
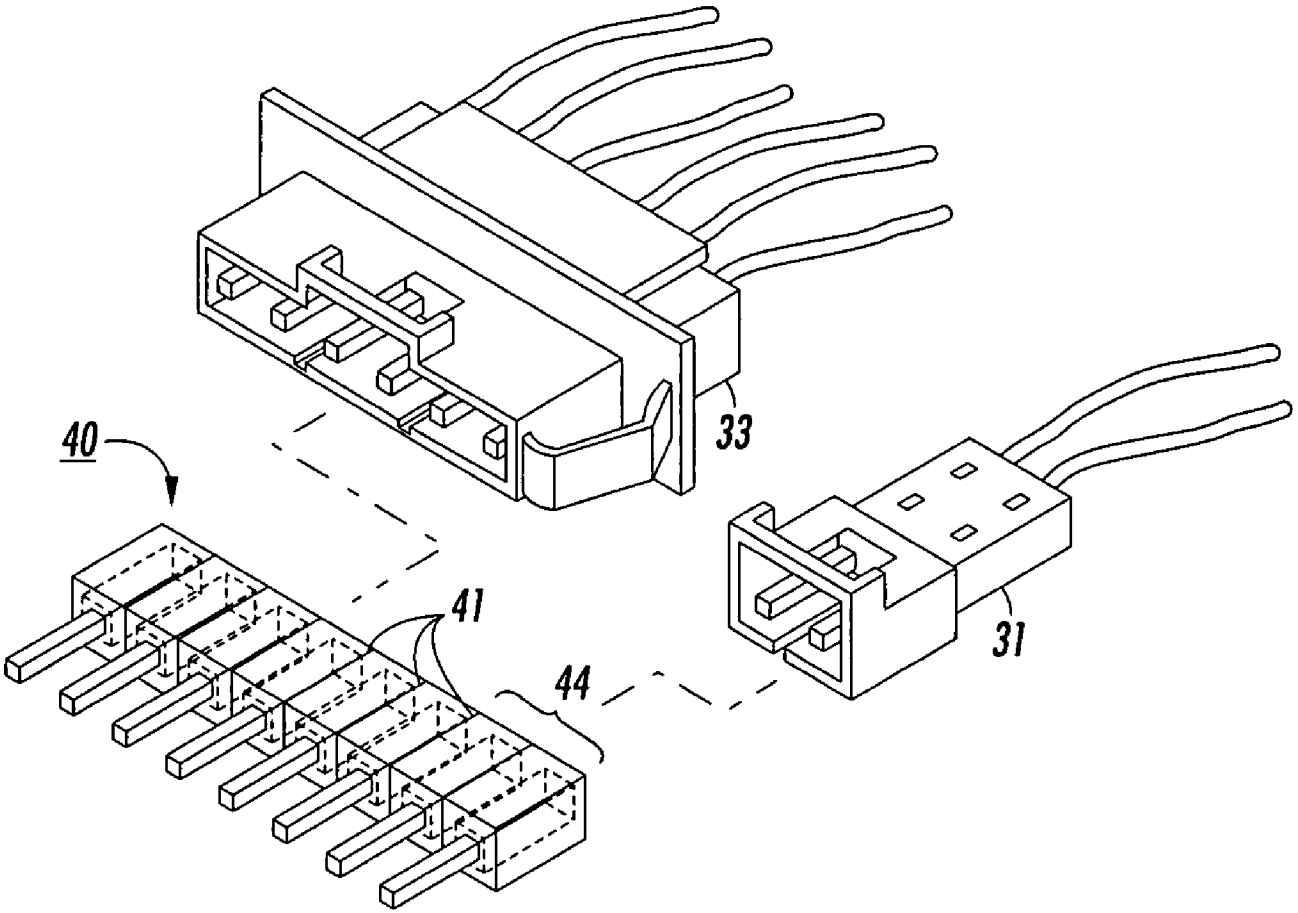
FIG. 3 is an elevated perspective view of another sacrificial connector embodiment of the present invention in which the sacrificial connector may be adapted for connection compatibility with a plurality of connector terminal configurations.

Referring to FIG. 3, another embodiment intended to enable a single sacrificial connector design to achieve connection compatibility with a plurality of different connector terminal configurations is shown. As shown, sacrificial connector 40 comes with N-pins and sockets (8 are shown). Each pin and socket pair is coupled with adjoining pin and socket pairs by a break-away, or separation, joint 41. If connection is desired with a 6-wire terminal connector such as connector terminal 33, then a segment of 6 pin and socket pairs are separated from the larger string of pin and socket pairs. Likewise, if connection is desired with a 2-wire connector terminal such as connector terminal 31, then, as shown, two pairs of pins and sockets identified as connector 44 are separated. In similar manner, sacrificial connectors such as connector 40 can be adapted for connection compatibility with a great variety of connector terminals provided that the height, width, and pin configurations remain connection compatible.

Within an electrostatographic print engine, a 6-wire configuration harnesses such as shown in FIGS. 2 and 3 are often used to couple connector terminal 33 directly or indirectly to key components such as Customer Replaceable Cartridges (CRU's). Such CRU's may comprise toner, photoreceptor, motors, and developing and cleaning apparatus, all of which require power and data circuits between the main print engine and the CRU.

In review, sacrificial connectors of the present invention provide a low-cost method for increasing reliability of systems and components and of minimizing service and replacement costs of circuit components. By extending the life of conventional low cost connectors, fewer expensive wire harnesses will need to be replaced and fewer manual in situ replacements of connectors will be made. As shown, further cost savings may result by designing sacrificial connectors to be compatible with a plurality of wire harness and component connectors.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A process for extending the replacement life of a machine wiring harness that is electrically connecting at least one repeatedly replaced machine component to at least one electrical source within the machine, said wiring harness having at least first and second electrical connectors normally inter-connecting with one another, one of which has multiple male electrical contacts and the other of which has multiple female electrical contacts, said wiring harness connecting to said repeatedly replaced machine component with said first electrical connector and connecting to said at least one electrical source within the machine with said second electrical connector, wherein said second electrical connector has a limited rated number of connect and disconnect cycles, and where the expected number of connect and disconnect cycles of said second electrical connector may exceed said rated limited number of connect and disconnect cycles, interposing a sacrificial electrical connector that is electrically connecting between said first and second electrical connectors of said wiring harness and physically separating said first and second electrical connectors from one another, said interposed sacrificial connector having multiple male electrical contacts on one side thereof directly electrically connecting with respective multiple female electrical contacts on another side thereof to provide the same electrical connections for said wiring harness as said normal connection of said first and second electrical connectors of said wiring harness to one another, said multiple male electrical contacts on said one side of said sacrificial connector being removably connected to said multiple female electrical contacts of said wiring harness electrical connector terminals and said multiple female electrical contacts on said other side of said sacrificial connector being removably connected to said multiple male electrical contacts of said wiring harness electrical connector terminals, to provide the same electrical connections as said normal connection of said first and second electrical connectors, multiply disconnecting and reconnecting said sacrificial electrical connector in multiple cycles from said first electrical connector, rather than disconnecting said first and second electrical connectors from one another, for said repeated replacement of said repeatedly replaceable machine component, to increase said rated limited number of connect and disconnect cycles and reduce replacements of said wiring harness, wherein said first electrical connector connects with said at least one replaceable machine component and wherein said multiply disconnecting and reconnecting of said sacrificial electrical connector in multiple cycles is restricted to only one side of said sacrificial electrical connector by a locking system on said sacrificial electrical connector restricting disconnecting and reconnecting of said sacrificial electrical connector between said sacrificial electrical connector and said second electrical connector.

* * * * *